US007222496B2

(12) United States Patent
Choi et al.

(10) Patent No.: US 7,222,496 B2
(45) Date of Patent: May 29, 2007

(54) HEAT PUMP TYPE AIR CONDITIONER HAVING AN IMPROVED DEFROSTING STRUCTURE AND DEFROSTING METHOD FOR THE SAME

(75) Inventors: Yeun Geun Choi, Asan-si (KR); Sung Tae Kim, Cheonan-si (KR)

(73) Assignee: Winiamando Inc., Choongchungnam-Do (KR)

( * ) Notice: Subject to any disclaimer, the term of this patent is extended or adjusted under 35 U.S.C. 154(b) by 161 days.

(21) Appl. No.: 11/158,352

(22) Filed: Jun. 16, 2005

(65) Prior Publication Data

US 2005/0279117 A1 Dec. 22, 2005

(30) Foreign Application Priority Data

Jun. 18, 2004 (KR) ..... 10-2004-0045718
Jun. 18, 2004 (KR) ..... 10-2004-0045719

(51) Int. Cl.
*F25B 13/00* (2006.01)

(52) U.S. Cl. ..... 62/324.5; 62/151; 62/278; 165/299

(58) Field of Classification Search ..... 62/151, 62/278, 324.5; 165/267, 297, 299
See application file for complete search history.

(56) References Cited

U.S. PATENT DOCUMENTS 5,701,753 A * 12/1997 Iritani ..... 62/211
5,782,102 A * 7/1998 Iritani et al. ..... 62/197
6,725,679 B2 * 4/2004 Itoh et al. ..... 62/160
2004/0000399 A1 * 1/2004 Gavula ..... 165/299

FOREIGN PATENT DOCUMENTS

KR 1020030042835 A 6/2003
KR 1020030051091 A 6/2003

* cited by examiner

*Primary Examiner*—Melvin Jones
(74) *Attorney, Agent, or Firm*—John P. White; Cooper & Dunham LLP

(57) ABSTRACT

A heat pump type air conditioner having an improved defrosting structure and a defrosting method for the same. When frost is not excessively accumulated on piping of an outdoor heat exchanger, a solenoid valve is controlled such that warm refrigerant from a compressor intermittently passes through a second pipe line, a heat discharging pipe line, and a third pipe line. When the air conditioner is operated in heating mode, the amount of frost accumulated on the outdoor heat exchanger is deduced from the temperature of the piping of the outdoor heat exchanger, and then a defrosting operation is performed based on the temperature of the piping of the outdoor heat exchanger. Consequently, the frost accumulated on the outdoor heat exchanger is quickly removed based on the amount of frost accumulated on the outdoor heat exchanger, and the period of time for which the air conditioner is not operated is reduced, whereby more comfortable and pleasant heating function is provided to a user.

10 Claims, 4 Drawing Sheets

HEAT PUMP TYPE AIR CONDITIONER HAVING AN IMPROVED DEFROSTING STRUCTURE AND DEFROSTING METHOD FOR THE SAME

BACKGROUND OF THE INVENTION

1. Field of the Invention

The present invention relates to a heat pump type air conditioner, and, more particularly, to a heat pump type air conditioner having an improved defrosting structure that is capable of removing frost accumulated on an outdoor heat exchanger while minimizing user discomfort when a heating operation is performed in low-temperature outdoor air. Also, the present invention relates to a defrosting method for such a heat pump type air conditioner.

2. Description of the Related Art

FIG. 1 is a block diagram illustrating the structure of a conventional heat pump type air conditioner. As shown in FIG. 1, the conventional heat pump type air conditioner comprises: a compressor 11 for compressing and circulating refrigerant; a four-way valve 12 for converting the flow direction of the refrigerant such that the refrigerant can flow either in the forward or reverse direction; an outdoor heat exchanger 13 configured to serve as a condenser when a cooling operation is performed and an evaporator when a heating operation is performed; an outdoor fan 14 for suctioning outdoor air; an indoor heat exchanger 15 configured to serve as an evaporator when a cooling operation is performed and a condenser when a heating operation is performed; an indoor fan 16 for suctioning indoor air; and an expansion valve 17 disposed between the outdoor heat exchanger 13 and the indoor heat exchanger 15 for changing the refrigerant into low-temperature and low-pressure gas refrigerant.

The condenser serves to remove heat from high-temperature and high-pressure gas refrigerant such that the high-temperature and high-pressure gas refrigerant is cooled, and therefore, is liquefied. On the other hand, the evaporator serves to lower the temperature of air coming into contact with the surface of the evaporator such that the temperature of moisture in the air falls below the dew point, and therefore, the moisture is changed into water drops, which will be removed.

The four-way valve 12 serves to convert the flow direction of the refrigerant such that the refrigerant discharged from the compressor 11 can flow to the outdoor heat exchanger 13 when a cooling operation is performed and to the indoor heat exchanger 15 when a heating operation is performed.

The operation of the conventional heat pump type air conditioner with the above-stated construction will be described below in detail.

When a user operates the conventional heat pump type air conditioner in cooling mode, the compressor 11 compresses refrigerant, and then supplies the compressed refrigerant to the outdoor heat exchanger 13. The outdoor heat exchanger 13 performs heat exchange between the refrigerant introduced into the outdoor heat exchanger 13 and air suctioned by the outdoor fan 14. As a result, the refrigerant is condensed into room-temperature and high-pressure liquid refrigerant, and the temperature of the air is increased. The increased-temperature air is discharged out of the air conditioner by the outdoor fan 14. The refrigerant condensed by the outdoor heat exchanger 13 passes through a capillary tube, with the result that the condensed refrigerant is changed into low-temperature and low-pressure liquid refrigerant. The indoor heat exchanger 15 performs heat exchange between the refrigerant introduced into the indoor heat exchanger 15 and air suctioned by the indoor fan 16. As a result, the refrigerant is changed into a low-temperature and low-pressure vapor refrigerant, and the temperature of the suctioned air is decreased. The low-temperature and low-pressure vapor refrigerant is delivered to the compressor through refrigerant piping, and the decreased-temperature air is discharged into the interior of a room by the indoor fan 15 to cool the interior of the room.

When the user operates the conventional heat pump type air conditioner in heating mode, on the other hand, the four-way valve 12 converts the flow direction of the refrigerant such that the refrigerant can flow from the compressor 11 to the indoor heat exchanger 15. In this case, the outdoor heat exchanger 13 serves as an evaporator, and the indoor heat exchanger 15 serves as a condenser. As a result, a heating operation is performed.

When the outdoor temperature drops to approximately 5° C. to 6° C. (relative humidity 80%), the surface temperature of the outdoor heat exchanger 13 falls below 0° C., and therefore, moisture in the outdoor air is accumulated on the surface of the outdoor heat exchanger 13. As a result, an air channel created by the outdoor fan 14 is interrupted. Consequently, the thermal efficiency of the outdoor heat exchanger is decreased, and the heating efficiency of the heat pump is significantly decreased.

In order to solve the above-mentioned problems, a defrosting operation for removing front accumulated on the surface of the outdoor heat exchanger 13 is performed. The defrosting operation will be described below in detail with reference to FIG. 2. After a heating operation has been performed for a predetermined period of time, for example, 30 minutes, the temperature of the indoor heat exchanger is measured by an indoor heat exchanger temperature sensor 18 (see FIG. 1), the temperature of the interior of the room is measured by a room temperature sensor 19 (see FIG. 1), and then it is determined whether the outdoor unit is to be defrosted based on the difference between the measured temperature of the indoor heat exchanger and the measured temperature of the interior of the room (Step S1). When it is determined that the outdoor unit is to be defrosted, a pressure balancing operation is performed for approximately 3 minutes, and then a defrosting operation is initiated (Step S2). The defrosting operation is performed for a predetermined period of time, for example, approximately 9 minutes (Step S3). The time required to perform the defrosting operation is set based on the difference between the temperature of the indoor heat exchanger and the temperature of the interior of the room. Subsequently, another pressure balancing operation is performed for approximately 3 minutes, and then a heating operation is performed (Step S4). As can be easily understood from the above description, the pressure balancing operation is performed for approximately 3 minutes, during which time the heating operation is paused. Consequently, it is not possible to perform the heating operation while the defrosting operation is performed. Furthermore, cool air is delivered to the interior of the room from the outdoor heat exchanger, and therefore, the temperature of the interior of the room is lowered, which inconveniences the user. In addition, the outdoor temperature is deduced from the difference between the temperature of the indoor heat exchanger and the temperature of the interior of the room. Consequently, it is difficult to accurately obtain a period of time for which the defrosting operation is performed, and therefore, it is difficult to smoothly perform the defrosting operation.

SUMMARY OF THE INVENTION

Therefore, the present invention has been made in view of the above problems, and it is an object of the present invention to provide a heat pump type air conditioner having an improved defrosting structure that is capable of removing frost accumulated on an outdoor heat exchanger while minimizing user discomfort when a heating operation is performed.

To this end, the air conditioner according to the present invention incorporates a defrosting mechanism that is capable of removing frost from the outdoor heat exchanger without performing a cooling operation in a reverse cycle if frost is not excessively accumulated on the piping of the outdoor heat exchanger. Warm refrigerant from a compressor is intermittently supplied to the outdoor heat exchanger through the defrosting mechanism, and therefore, frost accumulated on the piping of the outdoor heat exchanger is more easily removed.

It is another object of the present invention to provide a defrosting method for a heat pump type air conditioner in low-temperature outdoor air that is capable of accurately obtaining a period of time for which a defrosting operation is performed using a sensor attached to piping of the outdoor heat exchanger, thereby mining a period of time for which a heating operation is paused.

In accordance with one aspect of the present invention, the above and other objects can be accomplished by the provision of a heat pump type air conditioner having an improved defrosting structure, the air conditioner comprising: a compressor for compressing refrigerant; an indoor heat exchanger for performing heat exchange with indoor air; an outdoor heat exchanger for performing heat exchange with outdoor air; and a first pipe line connecting the compressor, the indoor heat exchanger and the outdoor heat exchanger in a closed loop, wherein the improvement comprises: a heat discharging pipe line disposed in the outdoor heat exchanger; a second pipe line connected between the inlet of the heat discharging pipe line and the compressor; a third pipe line connected between the outlet of the heat discharging pipe line and the first pipe line; and a valve mounted on either the second pipe line or the third pipe line.

When the temperature of piping of the outdoor heat exchanger is between −15° C. and 0° C., i.e., when frost is not excessively accumulated on the piping of the outdoor heat exchanger, relatively warm refrigerant discharged from the compressor is supplied to the heat discharging pipe line only for a short period of time such that the frost accumulated on the piping of the outdoor heat exchanger is removed. In this way, the warm refrigerant intermittently flows through the heat discharging pipe line without performing a cooling operation in a reverse cycle such that the air conditioner is operated in cooling mode, not in heating mode, whereby frost is effectively prevented from being accumulated on the piping of the outdoor heat exchanger.

Preferably, the heat pump type air conditioner further comprises: a four-way valve mounted on the first pipe line for converting the flow direction of the refrigerant; and a check valve disposed between the indoor heat exchanger and the outdoor heat exchanger.

Preferably, the valve is a solenoid valve. In this case, supply of the warm refrigerant to the heat discharging pipe line is electronically controlled based on the temperature of the piping of the outdoor heat exchanger.

Preferably, the heat discharging pipe line is bypassed to the front surface of the outdoor heat exchanger. In this case, the frost accumulated on the piping of the outdoor heat exchanger is effectively removed.

In accordance with another aspect of the present invention, there is provided a defrosting method for a heat pump type air conditioner in low-temperature outdoor air, the method comprising the steps of: determining whether the temperature of the outdoor heat exchanger is above 0° C., which is Case A, the temperature of the outdoor heat exchanger is between a predetermined temperature and 0° C., which is Case B, or the temperature of the outdoor heat exchanger is below the predetermined temperature, which is Case C; and performing a heating operation without performing a defrosting operation in Case A, intermittently operating a solenoid valve to perform the defrosting operation in Case B, and operating a four-way valve and the solenoid valve in a reverse cycle to perform the defrosting operation in Case C.

When the heat pump type air conditioner is performed in heating mode, the amount of frost accumulated on the outdoor heat exchanger is deduced from the temperature of the piping of the outdoor heat exchanger, and then the defrosting operation is performed based on the temperature of the piping of the outdoor heat exchanger. As a result, the period of time for which the air conditioner is not operated, which is required to remove the frost, is reduced, whereby frost accumulated on the outdoor heat exchanger is effectively removed while minimizing user discomfort.

Preferably, the predetermined temperature is −15° C. to −10° C.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
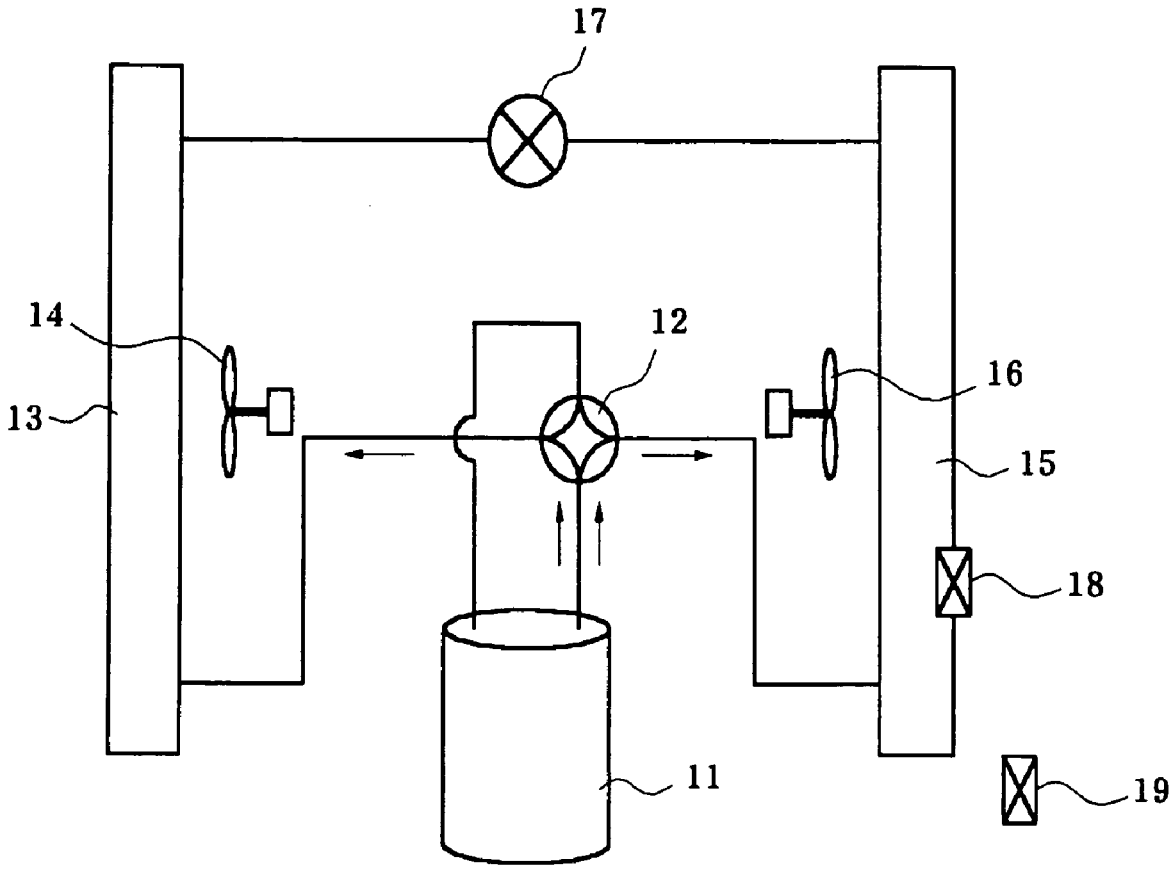
Fig. 1 (PRIOR ART)
FIG. 1 is a block diagram illustrating the structure of a conventional heat pump type air conditioner.
Figure 2:
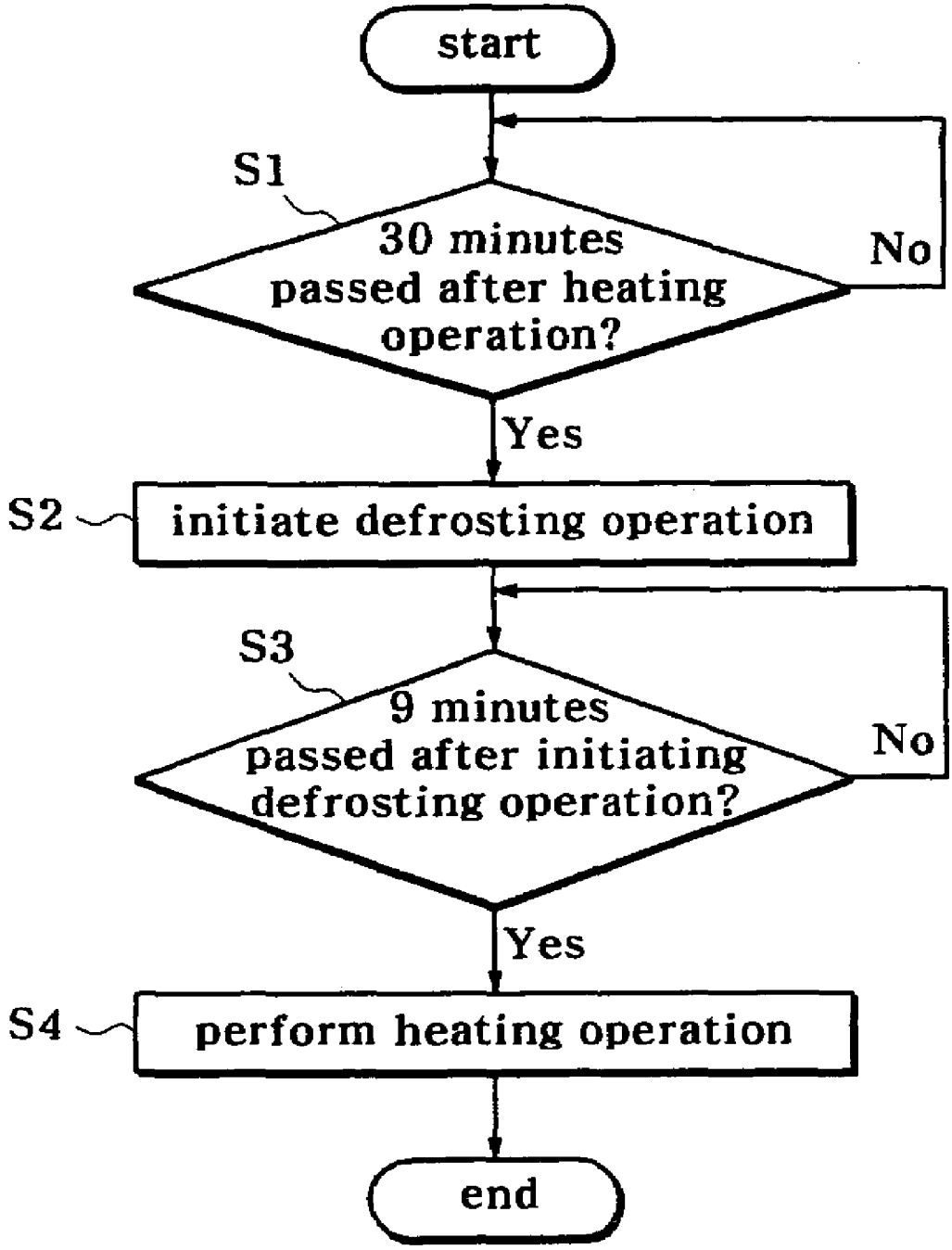
Fig. 2 (PRIOR ART)
FIG. 2 is a flow chart illustrating a defrosting method for the conventional heat pump type air conditioner shown in FIG. 1.
Figure 3:
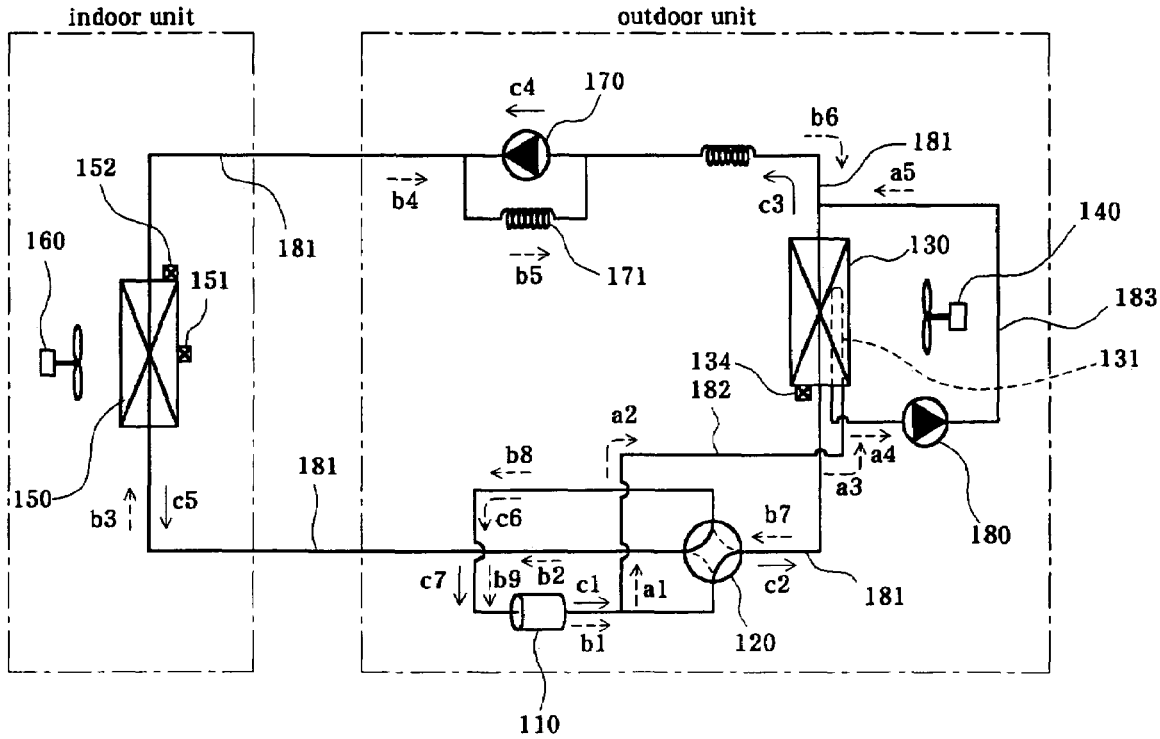
FIG. 3 is a block diagram illustrating the structure of a heat pump type air conditioner according to a preferred embodiment of the present invention.
Figure 4:
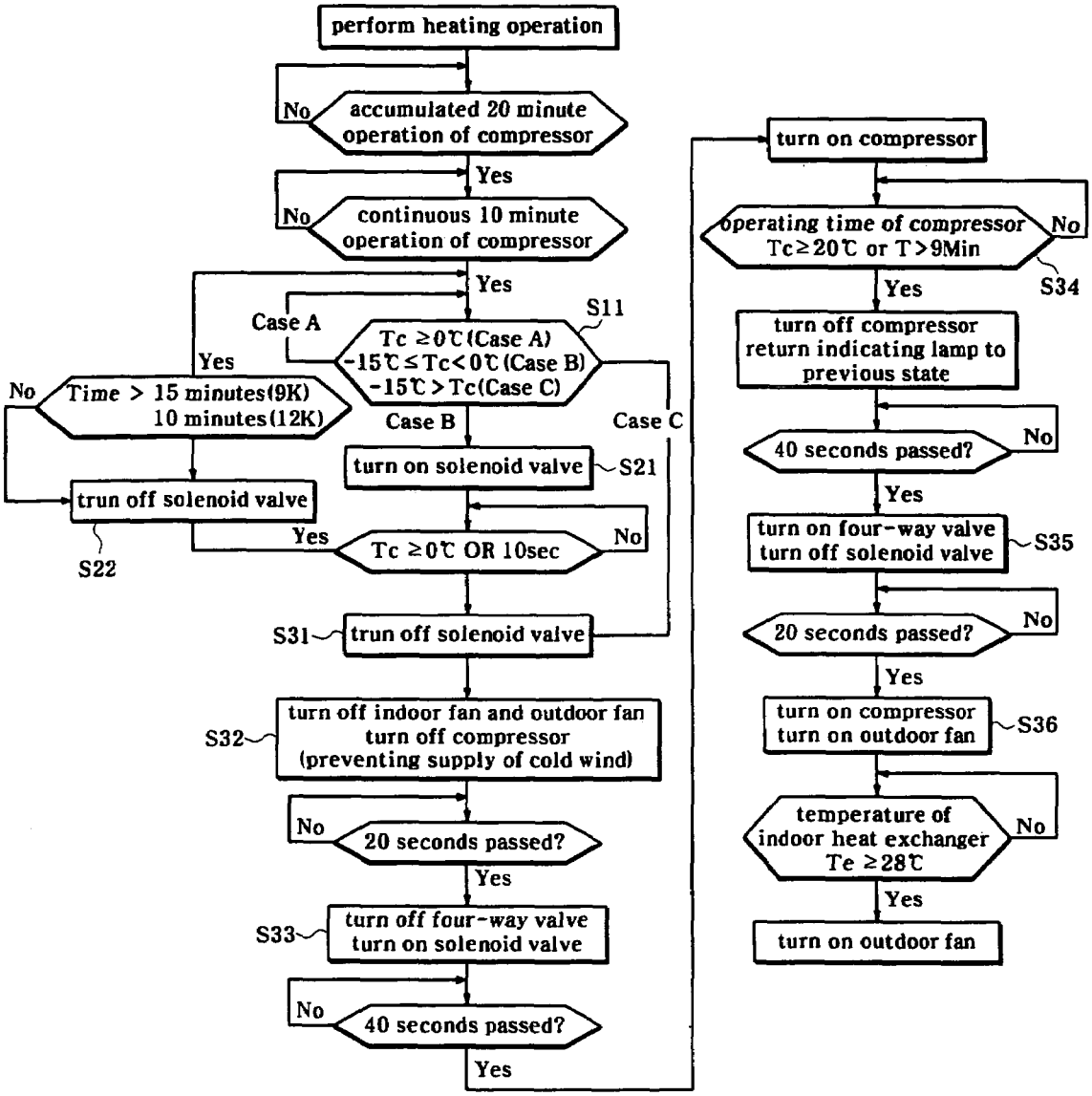
FIG. 4 is a flow chart illustrating a defrosting method for the heat pump type air conditioner according to the preferred embodiment of the present invention shown in FIG. 3.

FIG. 3 is a block diagram illustrating the structure of a heat pump type air conditioner according to a preferred embodiment of the present invention. As shown in FIG. 3, the heat pump type air conditioner according to the preferred embodiment of the present invention comprises: a compressor 110 for compressing and circulating refrigerant; a four-way valve 120 for converting the flow direction of the refrigerant such that the refrigerant can flow either in the forward or reverse direction; an outdoor heat exchanger 130 configured to serve as a condenser when a cooling operation is performed and an evaporator when a heating operation is performed; an outdoor fan 140 for suctioning outdoor air, an indoor heat exchanger 150 configured to serve as an evaporator when a cooling operation is performed and a condenser when a heating operation is performed; an indoor fan 160 for suctioning indoor air, a check valve 170 disposed between the outdoor heat exchanger 130 and the indoor heat exchanger 150 for changing the refrigerant into low-temperature and low-pressure gas refrigerant; a capillary tube 171 for changing refrigerant discharged from the outdoor heat exchanger 130 into low-temperature and low-pressure liquid refrigerant; and a defrosting mechanism for removing frost accumulated on piping of the outdoor heat exchanger 130, which is caused when the temperature of the outdoor air is below 0° C.

The indoor heat exchanger 150 and the indoor fan 160 constitute an indoor unit, which is installed in the room. The compressor 110 generating a relatively large amount of noise, the four-way valve 120, the outdoor heat exchanger 130, the outdoor fan 140, and the check valve 170 constitute an outdoor unit, which is installed outside the room.

The four-way valve 120 serves to convert the flow direction of the refrigerant such that the refrigerant discharged from the compressor 110 can flow to the outdoor heat exchanger 130 when a cooling operation is performed and to the indoor heat exchanger 150 when a heating operation is performed.

The outdoor heat exchanger 130 comprises an elongated pipe, which is bent several times, for example, in a serpentine shape, such that heat exchange with the outdoor air can be effectively preformed. To the outdoor heat exchanger 130 is attached a temperature sensor 134 for measuring the temperature of piping of the outdoor heat exchanger 130.

The indoor heat exchanger 150 has a temperature sensor 151 for measuring the temperature (Tr) of the interior of the room and another temperature sensor 152 for measuring the temperature (Te) of the refrigerant discharged from the indoor heat exchanger 150.

The check valve 170 allows the refrigerant to flow along a pipe line only in one direction.

The defrosting mechanism comprises: a heat discharging pipe line 131 disposed in the outdoor heat exchanger 130; a second pipe line 182 connected between the inlet of the heat discharging pipe line 131 and the compressor 110; a third pipe line 183 connected between the outlet of the heat discharging pipe line 131 and a first pipe line 181; and a solenoid valve 180 mounted on the third pipe line 183. The solenoid valve 180 is a valve that performs opening and closing function according to the operation of an electromagnet. The solenoid valve 180 is used to automatically perform the opening and closing functions based on an electric signal.

When a user operates the heat pump type air conditioner with the above-stated construction according to the present invention in cooling mode, refrigerant flows in the direction of the arrows indicated by solid lines c1 to c7. More specifically, the refrigerant is compressed by the compressor 110, passes through the first pipe line 181 in the direction of the arrow indicated by the solid line c1, and then flows counterclockwise in the direction of the arrows indicated by the solid lines c2 to c5. In this way, the refrigerant is circulated. While the refrigerant is circulated as described above, the refrigerant is changed into room-temperature and high-pressure liquid refrigerant by the outer heat exchanger 130, and then the room-temperature and high-pressure liquid refrigerant is changed into low-temperature and low-pressure vapor refrigerant by the indoor heat exchanger 150. As a result, the temperature of air is decreased. The refrigerant, which has been changed into the low-temperature and low-pressure vapor refrigerant by the indoor heat exchanger 150, is delivered to the compressor through the first pipe line 181, and the cooler air is discharged to the interior of the room through the indoor fan 150. In this way, the cooling operation is accomplished.

When the user operates the heat pump type air conditioner according to the present invention in heating mode, on the other hand, refrigerant flows in the direction of arrows indicated by dotted lines b1 to b9. More specifically, the refrigerant is compressed by the compressor 110, flows in the direction of the arrow indicated by the dotted line b1, passes through the four-way valve 120, and then flows clockwise in the direction of the arrows indicated by the solid lines b2 to b9. In this way, the refrigerant is circulated.

When the temperature of the outdoor air is below 0° C., warm refrigerant discharged from the compressor 110 is supplied to the outdoor heat exchanger 130 through the second pipe line 182 so as to remove frost accumulated on the piping of the outdoor heat exchanger 130. The refrigerant flows through the second pipe line 182 in the direction of arrows indicated by dotted lines a1 and a2. As a result, the warm refrigerant passes through the heat discharging pipe line 131 in the outdoor heat exchanger 130. At this time, heat exchange is performed between the warm refrigerant and the heat discharging pipe line 131, and therefore, frost accumulated on the piping of the outdoor heat exchanger 130 is effectively removed. Of course, the temperature of the refrigerant is decreased. The decreased-temperature refrigerant passes through the third pipe line 183, which is connected between the outlet of the heat discharging pipe line 131 and the first pipe line 181, and then joins the refrigerant flowing through the first pipe line 181.

The solenoid valve 180 may be mounted either on the second pipe line 182 or the third pipe line 183 so long as the solenoid valve 180 can allow the warm refrigerant to flow through the heat discharging pipe line 131 traversing the interior of in the outdoor heat exchanger 130 and stop the warm refrigerant from flowing through the heat discharging pipe line 131 traversing the interior of in the outdoor heat exchanger 130.

As described above, the defrosting mechanism which comprises the second pipe line and the third pipe line, the solenoid valve for allowing the warm refrigerant to be supplied to the outdoor heat exchanger and stopping the warm refrigerant from being supplied to the outdoor heat exchanger, and the heat discharging pipe line traversing the interior of the outdoor heat exchanger, is incorporated in the heat pump type air conditioner according to the present invention. The solenoid valve is controlled such that the warm refrigerant from the compressor intermittently passes through the second pipe line, the heat discharging pipe line, and the third pipe line when frost is not excessively accumulated on the piping of the outdoor heat exchanger. As a result, frost accumulated on the piping of the outdoor heat exchanger is more easily removed.

A detailed description will be made hereinafter of a defrosting method for the heat pump type air conditioner with the above-stated construction in the condition of low-temperature outdoor air according to a preferred embodiment of the present invention.

The defrosting method for the heat pump type air conditioner in the condition of low-temperature outdoor air comprises a step of determining whether the temperature (Tc) of the piping of the outdoor heat exchanger is above 0° C. (Case A), the temperature (Tc) of the piping of the outdoor heat exchanger is between −15° C. and 0° C. (Case B), or the temperature (Tc) of the piping of the outdoor heat exchanger is below −15° C. (Case C), after operating the compressor for a predetermined period of time, for example, approximately 30 minutes (Step S11).

In Case A, it is not necessary to perform a defrosting operation, and therefore, a heating operation is immediately initiated without performing the defrosting operation.

In Case B, the solenoid valve is intermittently operated to perform a defrosting operation (Step S21). More specifically, the solenoid valve disposed at the outdoor heat exchanger 130 is operated, i.e., the solenoid valve is turned on, for a predetermined period of time, for example, 10 seconds, or until the temperature (Tc) of the piping of the outdoor heat exchanger exceeds 0° C., and then the operation of the solenoid valve is stopped,. i.e., the solenoid valve is turned off, for a predetermined period of time, for example, 10 minutes to 15 minutes. In this way, the defrosting operation is performed. The reason why the solenoid valve is turned on for 10 seconds and turned off for 10 minutes to 15 minutes is to make sure that the decrease in heating efficiency is minimized in the B case. After the defrosting operation is completed as described above, a heating operation is performed.

In Case C, in which the temperature (Tc) of the piping of the outdoor heat exchanger is below −15° C., i.e., the temperature (Tc) of the piping of the outdoor heat exchanger is very low, it is required to more accurately perform a defrosting operation. In other words, a cooling operation is performed in a reverse cycle for a predetermined period of time such that the outer heat exchanger 130 serves as a condenser, and therefore, frost accumulated on the piping of the outer heat exchanger 130 is thawed by the heat of condensation.

More specifically, the solenoid valve is turned off for a predetermined period of time, for example, 20 seconds (Step S31), and the indoor fan 160 and the outdoor fan 140 are tuned off so as to prevent supply of cold wind (Step S32). Subsequently, the four-way valve is turned off and the solenoid valve is turned on for a predetermined period of time, for example, 40 seconds (Step S33), and the compressor is operated for a predetermined period of time, for example, 9 minutes (Step S34). Thereafter, the four-way valve is turned on and the solenoid valve is turned off for a predetermined period of time, for example, 20 seconds (Step S35), and the compressor and the outdoor fan are turned on to normally perform a heating operation (Step S36).

The heat discharging pipe line 131 is connected to the lower end of the outdoor heat exchanger 130, and therefore, the lower end of the outdoor heat exchanger 130 is thawed first, and then the whole piping of the outdoor heat exchanger 130 is thawed by a refrigerant circuit bypassed to the front surface of the outdoor heat exchanger 130. Also, gas discharged from the compressor remains at the lower end of the outdoor heat exchanger 130 while the heating operation is performed, and therefore, the defrosting operation is effectively performed at a region where heat exchange is not completely performed due to water drops falling from the upper end of the outdoor heat exchanger 130.

In Case C, two refrigerant lines where the four-way valve 120 and the solenoid valve are disposed are simultaneously opened so as to accomplish quick pressure equilibration. Consequently, a period of time for which the heating operation is paused is considerably reduced. For example, the period of time for which the heating operation is paused is 1 minute. This period of time is shorter than the period of time for which the heating operation is paused according to the prior art, which is 3 minutes. The defrosting operation is performed for 9 minutes according to the present invention. Also, the time required to perform a pressure balancing operation is considerably reduced. For example, the time required to perform the pressure balancing operation is 1 minute. This time is shorter than the time required to perform the pressure balancing operation according to the prior art, which is 3 minutes.

Consequently, the frost accumulated on the outdoor heat exchanger 130 is quickly removed based on the amount of frost accumulated on the outdoor heat exchanger through the defrosting process as described above. Also, the period of time for which the air conditioner is not operated, which is required to remove the frost, is reduced, and therefore, more comfortable and pleasant heating function is provided to a user.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

As apparent from the above description, the defrosting mechanism, which comprises the second pipe line and the third pipe line, the solenoid valve for allowing the warm refrigerant to be supplied to the outdoor heat exchanger and stopping the warm refrigerant from being supplied to the outdoor heat exchanger, and the heat discharging pipe line traversing the interior of in the outdoor heat exchanger, is incorporated in the heat pump type air conditioner according to the present invention. The solenoid valve is controlled such that the warm refrigerant from the compressor intermittently passes through the second pipe line, the heat discharging pipe line, and the third pipe line when frost is not excessively accumulated on the piping of the outdoor heat exchanger. Consequently, the present invention has the effect of more easily removing frost accumulated on the piping of the outdoor heat exchanger.

Furthermore, when the heat pump type air conditioner is operated in heating mode, the amount of frost accumulated on the outdoor heat exchanger is deduced from the temperature of the piping of the outdoor heat exchanger, and then the defrosting operation is performed based on the temperature of the piping of the outdoor heat exchanger. As a result, the frost accumulated on the outdoor heat exchanger is quickly removed based on the amount of frost accumulated on the outdoor heat exchanger. Also, the period of time for which the air conditioner is not operated, which is required to remove the frost, is reduced. Consequently, the present invention has the effect of providing more comfortable and pleasant heating function to a user.

What is claimed is:

1. A heat pump type air conditioner having an improved defrosting structure, the air conditioner comprising: a compressor for compressing refrigerant; an indoor heat exchanger for performing heat exchange with indoor air; an outdoor heat exchanger for performing heat exchange with outdoor air; and a first pipe line connecting the compressor, the indoor heat exchanger and the outdoor heat exchanger in a closed loop, wherein the improvement comprises:

a heat discharging pipe line disposed in the outdoor heat exchanger;

a second pipe line connected between the inlet of the heat discharging pipe line and the compressor;

a third pipe line connected between the outlet of the heat discharging pipe line and the first pipe line; and a valve mounted on either the second pipe line or the third pipe line.

2. The air conditioner as set forth in claim 1, further comprising:

a four-way valve mounted on the first pipe line for converting the flow direction of the refrigerant.

3. The air conditioner as set forth in claim 2, further comprising:

a check valve disposed between the indoor heat exchanger and the outdoor heat exchanger.

4. The air conditioner as set forth in claim 3, wherein the valve is a solenoid valve.

5. The air conditioner as set forth in claim 3, wherein the heat discharging pipe line is bypassed to the front surface of the outdoor heat exchanger.

6. A defrosting method for a heat pump type air conditioner in the condition of low-temperature outdoor air, the method comprising the steps of:

determining whether the temperature of the outdoor heat exchanger is above 0° C., which is Case A, the temperature of the outdoor heat exchanger is between a predetermined temperature and 0° C., which is case B, or the temperature of the outdoor heat exchanger is below the predetermined temperature, which is Case C; and performing a heating operation without performing a defrosting operation in Case A, intermittently operating a solenoid valve to perform the defrosting operation in Case B, and operating a four-way valve and the solenoid valve in a reverse cycle to perform the defrosting operation in Case C.

7. The method as set forth in claim 6, further comprising the steps of:

in Case B, turning on the solenoid valve for 10 seconds or until the temperature of the outdoor heat exchanger exceeds 0° C.; and turning off the solenoid valve for 10 minutes to 15 minutes.

8. The method as set forth in claim 6, wherein the predetermined temperature is −15° C. to −10° C.

9. The method as set forth in claim 6, further comprising the steps of:

in Case C, turning off the solenoid valve for 20 seconds, turning off the indoor fan and the outdoor fan;

turning off the four-way valve and turning on the solenoid valve for 40 seconds;

operating a compressor for 9 minutes;

turning on the four-way valve and turning off the solenoid valve for 20 seconds; and turning on the compressor and the outdoor fan to perform a heating operation.

10. The method as set forth in claim 8, further comprising the steps of:

in Case C, turning off the solenoid valve for 20 seconds, turning off the indoor fan and the outdoor fan;

turning off the four-way valve and turning on the solenoid valve for 40 seconds;

operating a compressor for 9 minutes;

turning on the four-way valve and turning off the solenoid valve for 20 seconds; and turning on the compressor and the outdoor fan to perform a heating operation.

* * * * *